US008672512B2

(12) United States Patent
Zhou et al.

(10) Patent No.: US 8,672,512 B2
(45) Date of Patent: Mar. 18, 2014

(54) OMNI REFLECTIVE OPTICS FOR WIDE ANGLE EMISSION LED LIGHT BULB

(75) Inventors: Li Zhou, Hong Kong (HK); Kai Chiu Wu, Hong Kong (HK); Enboa Wu, Hong Kong (HK)

(73) Assignee: Hong Kong Applied Science and Technology Research Institute Company Limited, Honk Kong Science Park Shatin, New Territories, Hong Kong ( * ) Notice: Subject to any disclaimer, the term of this patent is extended or adjusted under 35 U.S.C. 154(b) by 113 days.

(21) Appl. No.: 13/426,627

(22) Filed: Mar. 22, 2012

(65) Prior Publication Data

US 2012/0300453 A1 Nov. 29, 2012

Related U.S. Application Data

(60) Provisional application No. 61/538,145, filed on Sep. 23, 2011.

(51) Int. Cl.
*F21V 14/00* (2006.01)

(52) U.S. Cl.
USPC ..... 362/255; 362/341; 362/296.07

(58) Field of Classification Search
USPC ..... 362/218, 240, 241, 243, 247, 249.02, 362/255, 256, 296.05, 296.07, 311.02, 362/311.14, 294, 297, 298, 345
See application file for complete search history.

(56) References Cited

U.S. PATENT DOCUMENTS

| | | | | |
|---|---|---|---|---|
| 6,183,100 | B1 * | 2/2001 | Suckow et al. | 362/249.02 |
| 7,425,084 | B2 * | 9/2008 | Ruud et al. | 362/298 |
| 8,292,471 | B2 * | 10/2012 | Boonekamp et al. | 362/311.02 |
| 2007/0030666 | A1 * | 2/2007 | Cohen | 362/84 |
| 2012/0081894 | A1 * | 4/2012 | Simon et al. | 362/249.02 |
| 2012/0287624 | A1 * | 11/2012 | Harbers | 362/294 |

* cited by examiner

*Primary Examiner* — Y My Quach Lee
(74) *Attorney, Agent, or Firm* — Ella Cheong Hong Kong; Sam T. Yip

(57) ABSTRACT

A structure is provided to create an efficient light pattern conversion from a narrow angular light beam pattern of a light emitting source to a wide angle light intensity distribution for an omnidirectional lighting assembly. A heat conductive substrate includes an LED array with at least one central and at least one surrounding LED. A hollow light diverting component is positioned over the LED array; a central LED is within the hollow component while surrounding LEDs are positioned outside. Light emitted by the central LED is reflected off inner surfaces of the hollow component to be discharged from an upper opening. The outer component surface is configured to reflect light from the surrounding LEDs in azimuthal and circumferential directions towards a region below the upper opening. In this manner, plural LEDs are used to form a wide angle emission pattern suitable for use in conventional light bulb replacement devices.

20 Claims, 10 Drawing Sheets

OMNI REFLECTIVE OPTICS FOR WIDE ANGLE EMISSION LED LIGHT BULB

CLAIM FOR DOMESTIC PRIORITY

This application claims priority under 35 U.S.C. §119 to the U.S. Provisional Patent Application No. 61/538,145, filed Sep. 23, 2011, the disclosure of which is incorporated herein by reference in its entirety.

FIELD OF THE INVENTION

The present invention relates to LED light bulbs in general and, more particularly, to LED light bulbs with multiple LEDs and reflective optics to create a wide angle emission pattern.

BACKGROUND

Due to energy conservation and environmental protection issues, almost every developed region such as North America, Europe, Japan and Taiwan plan to forbid sale of incandescent light bulbs in the future. Consequently, LED lighting has become a leading replacement option for domestic and commercial use. It is expected the potential market revenue will reach 3 billion USD in 2013. As a result of these market forces, and the implementation of national standards or directives in different countries, LED luminaire makers need to develop a wide angle emission LED bulb to replace conventional incandescent light globes such as 45 W to 60 W "Edison-style" conventional incandescent light bulbs.

Thus there is a need in the art to facilitate an efficient light pattern conversion from a narrowed angular light beam pattern of light emitting source such as an LED to a wide angular light intensity distribution for omnidirectional lighting required by lighting assemblies.

SUMMARY OF THE INVENTION

The invention provides a structure to facilitate an efficient light pattern conversion from a narrow angular light beam pattern of a light emitting source to a wide angle light intensity distribution for a lighting assembly that provides omnidirectional lighting.

In one embodiment, a wide angle emission LED assembly includes a heat conductive substrate. Positioned on the substrate surface are at least two light emitting diodes (LEDs). At least one LED is disposed at a predefined position within a central region of the substrate while the remaining LEDs surround the central LED.

A hollow light diverting component is positioned over the heat conductive substrate. The component is positioned such that a first opening is at a first end adjacent the substrate and a second opening larger than the first opening is at the second end. The first opening encloses the central LED while at least one LED is positioned outside the first opening.

The hollow light diverting component is configured such that light emitted by the central LED is reflected off one or more inner surfaces of the hollow light diverting component to be discharged from the second opening. The outer surface of the hollow light diverting component is configured to reflect light from the LEDs surrounding the central LED in azimuthal and circumferential directions towards a region below the second opening of the hollow light diverting component. In this manner, plural LEDs are used to form a wide angle emission pattern suitable for use in conventional light bulb replacement devices.

DETAILED DESCRIPTION

The invention provides a structure to facilitate an efficient light pattern conversion from a narrowed angular light beam pattern from light emitting sources to a wide angle light intensity distribution in the application of lighting assemblies for providing omnidirectional lighting.

Figure 1:
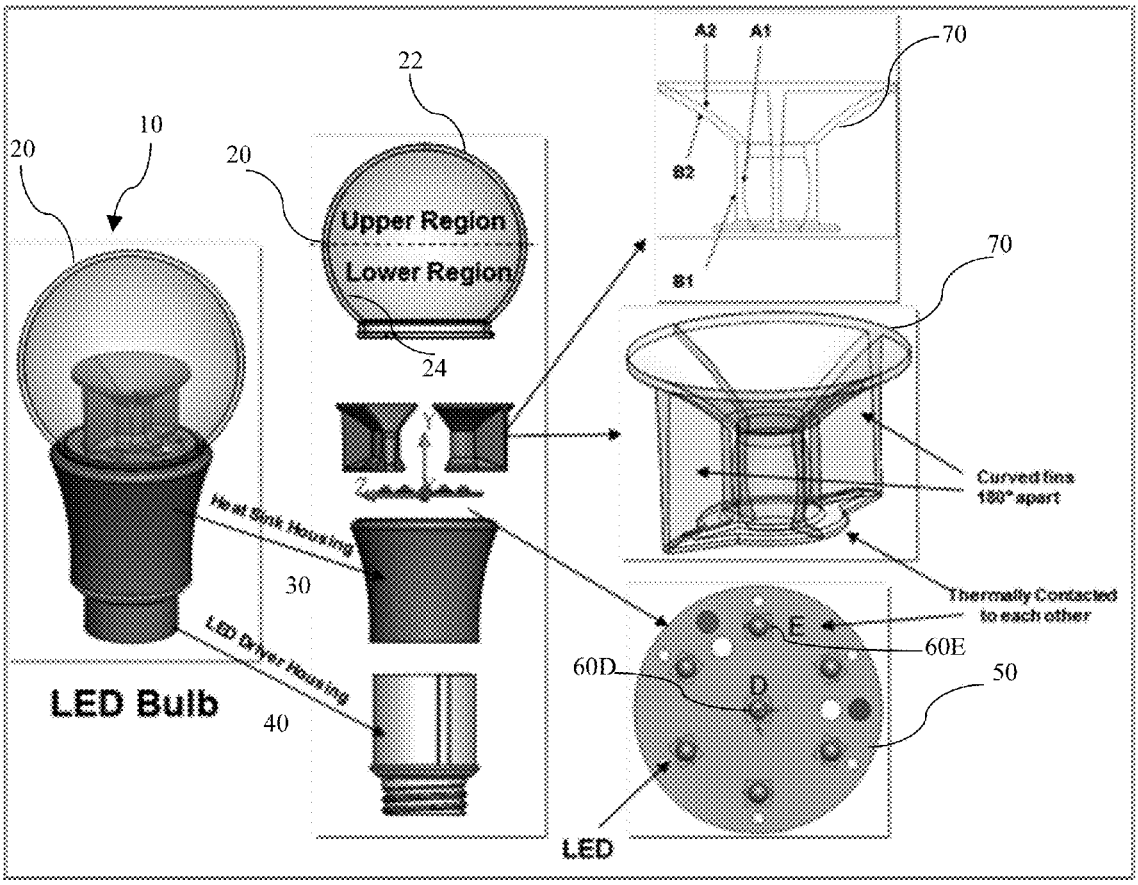
FIG. 1 is an overview of the wide angle emission LED assembly of the present invention.

Turning to the drawings in detail, FIG. 1 depicts an overview of the lighting assembly of the present invention. LED bulb 10 is an exemplary external shape of an omnidirectional LED lighting element particularly useful as a replacement for conventional incandescent light bulbs. Bulb 10 includes an enclosure 20 having an upper region 22 and a lower region 24. Enclosure 20 is transparent or translucent; scattering material can be coated on an inner surface or outer surface of enclosure 20 or formed within the material of enclosure 20. The LED bulb exterior also includes a heat sink portion 30 and an electrical supply/LED driver contact portion 40 shown with a conventional threaded socket connector.

Within LED bulb 10, heat conductive substrate 50 supports an array of light emitting diodes (LEDs) 60. Optionally, the heat conductive substrate 50 includes an optically reflective surface. In an exemplary embodiment, a central LED 60D is surrounded by one or more surrounding LEDs 60E. A variety of configurations can be used including configurations with plural central LEDs and plural surrounding LEDs.

Figures 2A, 2B:
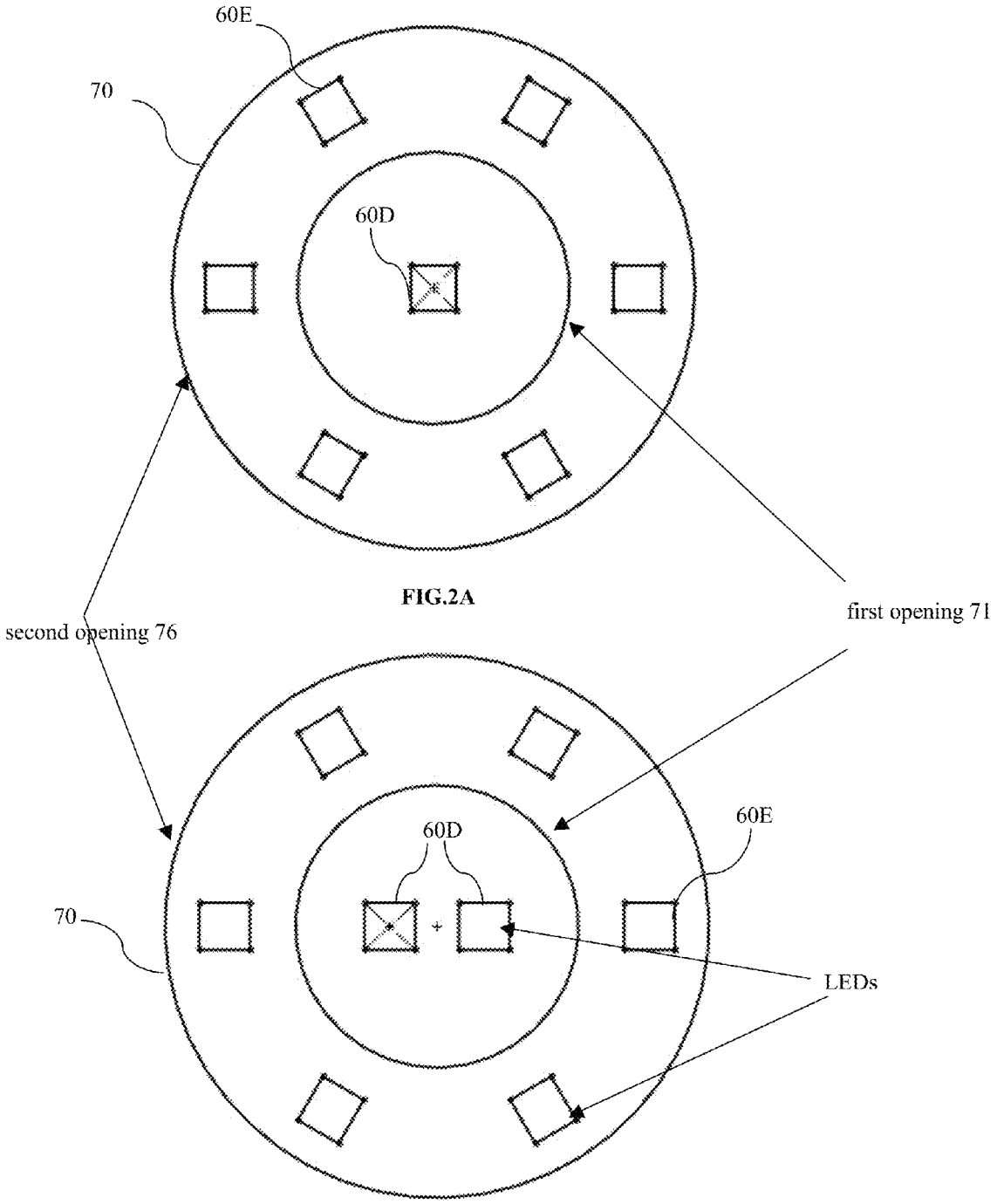
FIG. 2A is a top view of the hollow light diverting component and LED arrangement of the assembly of FIG. 1.
FIG. 2B is a top view of an alternative configuration in which more than one LED is positioned within the inner portion of the hollow light diverting component.

To create a wide angle lighting device with a more uniform light emission pattern, a hollow light diverting component 70 is positioned over LED array 60. One or more central LEDs are positioned within the hollow light diverting component 70 and one or more surrounding LEDs are positioned outside the hollow light diverting component. FIG. 2A, depicts a top view of the hollow component 70 positioned over an LED array 60. In this configuration a single LED 60D is positioned within hollow light diverting component 70; FIG. 2B depicts a configuration in which more than one LED 60D is positioned within hollow light diverting component 70 (that is, with first opening 71). LEDs 60E are positioned surrounding the exterior of the hollow light diverting component and optionally within the projection of second opening 76 onto the substrate as discussed below. Selection of the LED positioning within and outside the hollow light diverting component is determined based on the overall desired emission characteristics of the final lighting assembly. The various light emission characteristics of the hollow light diverting component and the various configurations of the hollow light diverting component are explained below with reference to FIGS. 3 through 9.

Figure 3:
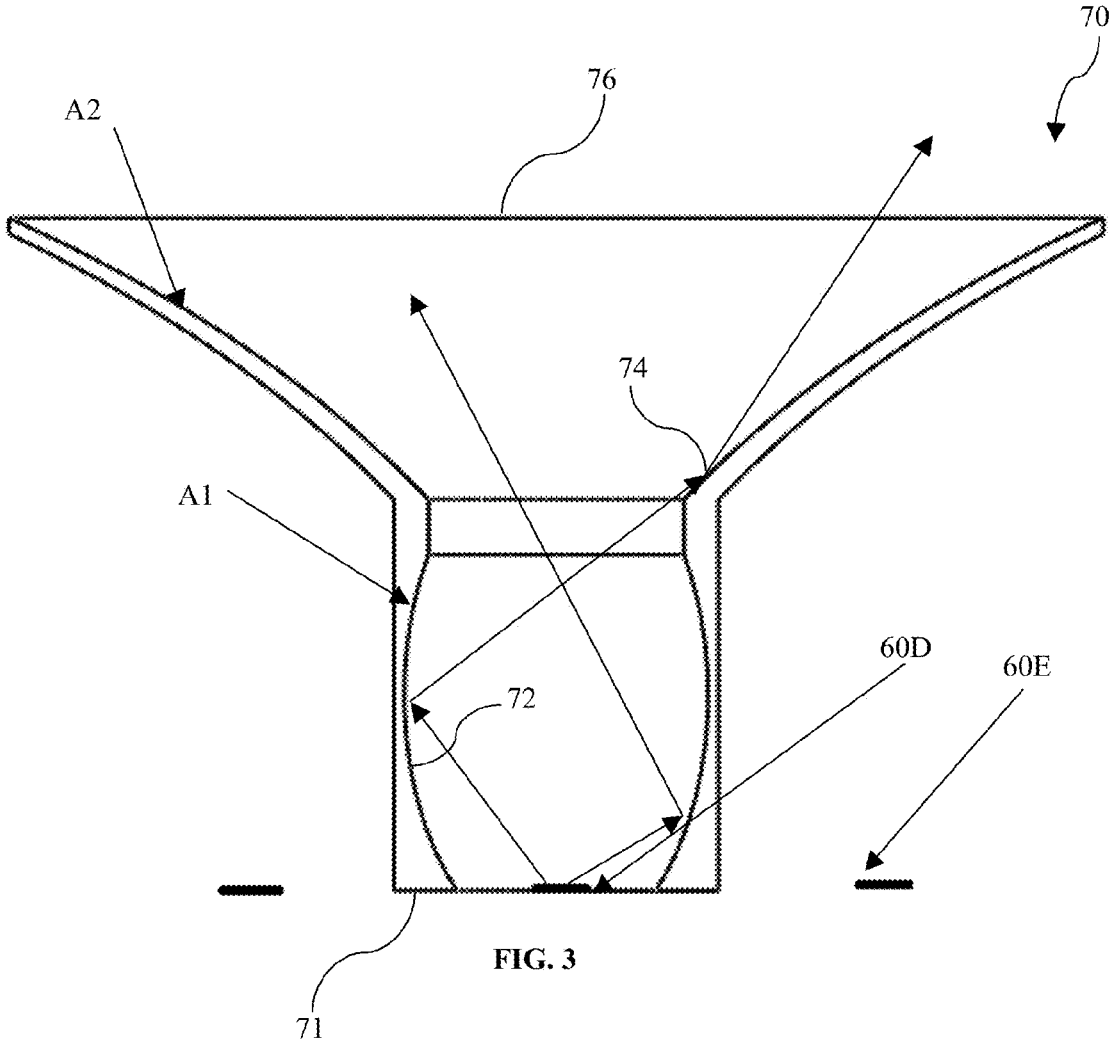
FIG. 3 depicts a function of an inner surface of a hollow light diverting component of the assembly of FIG. 1.

As seen in FIG. 3, hollow light diverting component 70 includes a first opening 71 that is positioned adjacent the LED array 60. A larger second opening 76 outputs light from the light diverting component. Light from central LED 60D enters the first opening 71 and is reflected by lower portion hollow component inner surface 72 and/or is again reflected by upper portion inner surface 74. These surfaces are optically reflective. Note that only some possible light and inner surface interactions are shown. Some light may not reflect off the inner surface while some light may be reflected one or more times off various portions of the inner surfaces of the hollow element.

Further, it is noted that the hollow component can take a variety of shapes depending on the selected number and pattern of LEDs in the array and on the desired light emission characteristics of the overall device. In the embodiment of FIG. 3, the lower inner surfaces are concave while the upper surfaces are slightly concave. However, any of the surfaces may be flat, convex, or concave depending on the desired reflection and emission characteristics. In the particular embodiment of FIG. 3 the surfaces labeled A1 and A2 convert the emission light pattern from central LEDs to a wide angular light distribution at the output 76 of the hollow component.

Figure 4:
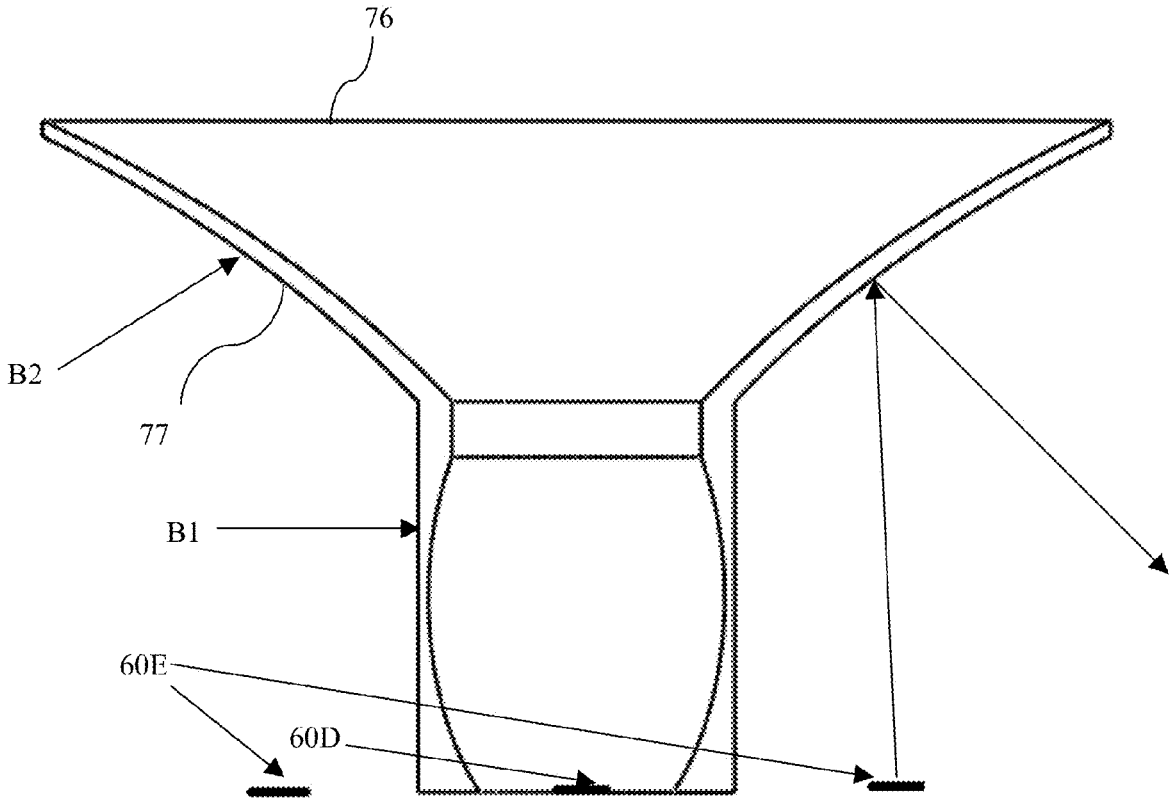
FIG. 4 depicts a function of an outer surface of a hollow light diverting component of the assembly of FIG. 1.

FIG. 4 depicts reflection characteristics of the outer surfaces of hollow light diverting component 70. In FIG. 4, a surrounding LED 60E emits light which is reflected off outer surface 77 (also labeled B2). Although not shown in FIG. 4, light will also be reflected from surface B1. The outer surfaces are all optically reflective with selected curvature such that surfaces B1 and B2 control light emitted from the surrounding LEDs 60E to a region "below" the reflector in the azimuthal direction. That is, as compared to the light exiting from opening 76, light reflected from surfaces B1 and B2 will tend to exit bulb 10 from the sides and lower regions to contribute to the desired omnidirectional emission pattern. This corresponds to lower region 24 of translucent enclosure 20 while light exiting from opening 76 will tend to be emitted from upper region 22 of translucent enclosure 20.

Figure 5:
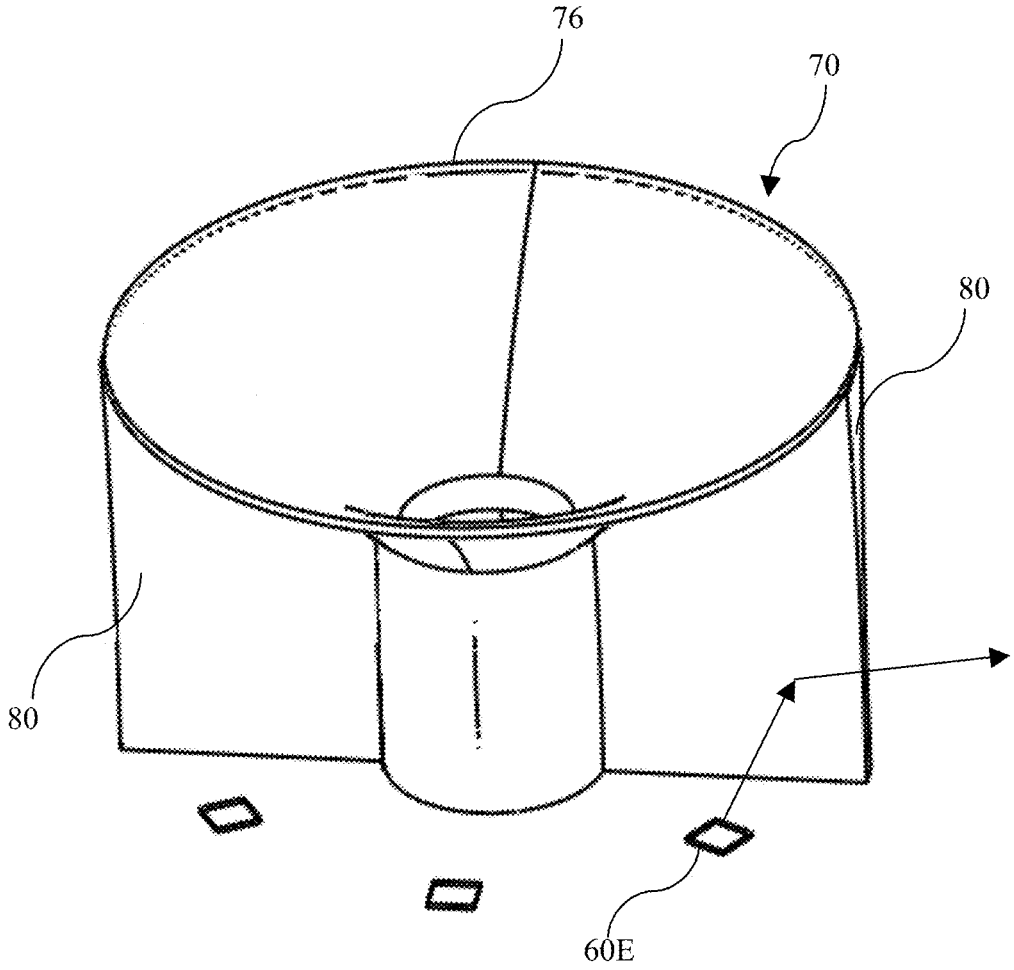
FIG. 5 depicts a hollow light diverting component with heat transferring fins.
Figure 6A:
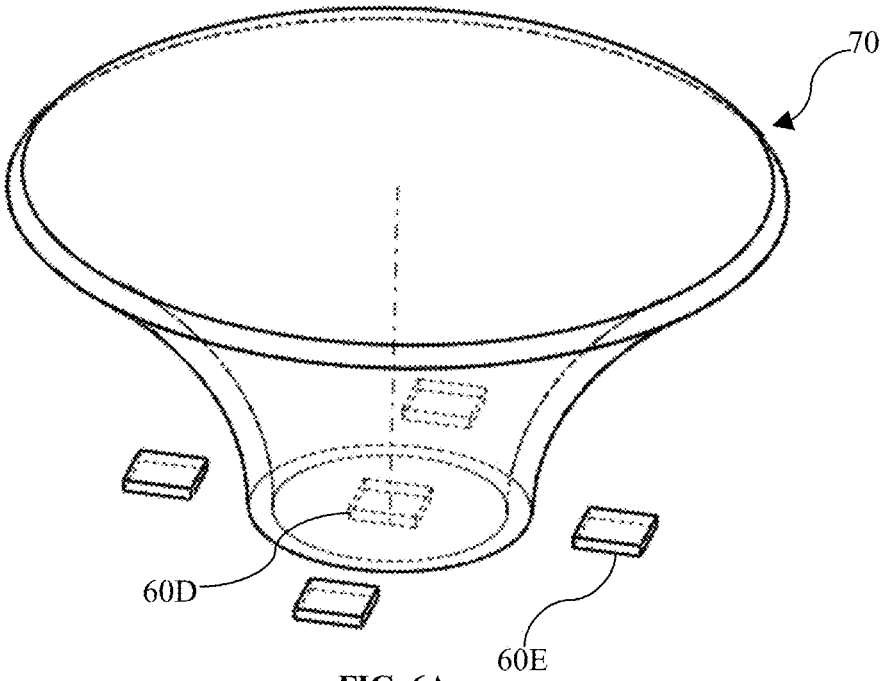
FIG. 6A depicts a light emitting assembly with a concave shaped hollow light diverting component.
Figure 6B:
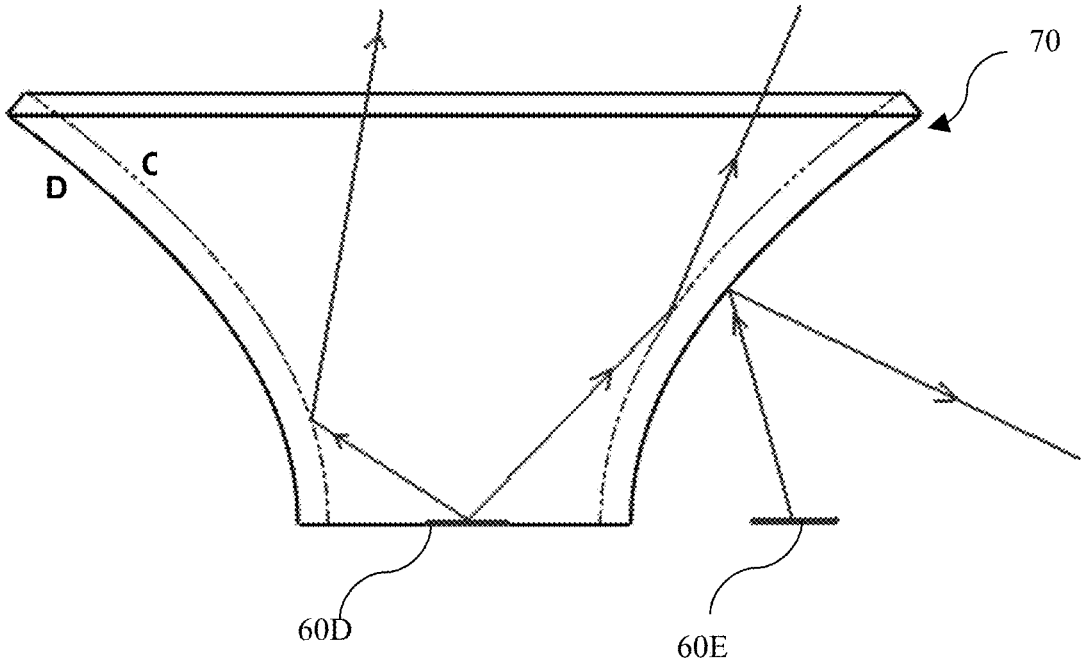
FIG. 6B depicts the reflected direction of rays from a central LED and from surrounding LEDs of the component of FIG. 6A.

To further enhance the emission from bulb 10, the hollow light diverting component can include optional extensions 80 as shown in FIG. 5. Extensions 80 are configured in a fin shape with reflective surfaces than can further reflect light emitted by the surrounding LEDs 60E. The fin is profiled to a selected curvature so that it precisely controls the light emitted from the surrounding LEDs below the hollow component in the circumferential direction. In the configuration of FIG. 5, two fins spaced 180 degrees apart are shown. However, more or fewer fins may be selected and spaced at other intervals (e.g., 3 fins spaced 120 degrees apart).

Alternative configurations for the hollow light diverting component are depicted in FIGS. 6-9. In FIGS. 6A and 6B, the inner surface is convex while the outer surface is concave. The resultant light reflections for the central and surrounding LEDs are shown in FIG. 6B. Inner surface C can follow outer surface D, and reflect rays to the upper region.

Figure 7:
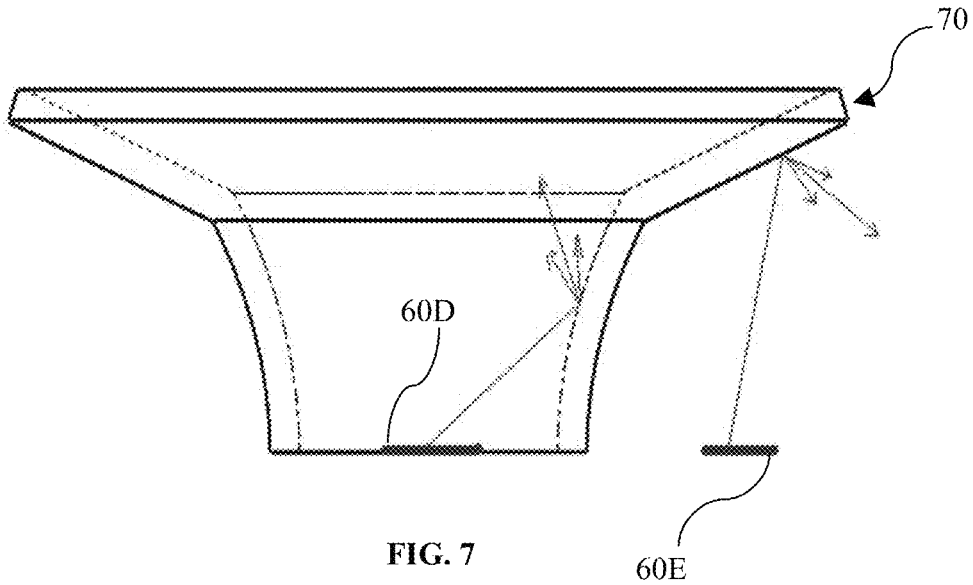
FIG. 7 depicts a light emitting assembly with the hollow light diverting component having a concave surface and sloping surface, and the reflections of the surfaces.

In FIG. 7 the outer surfaces of the hollow light diverting component includes at least a concave portion and at least a slanted portion. The inner surface contour can follow the outer surface contour. The surfaces of the hollow diverting component are specular reflective or diffusive reflective or a combination of the two reflections. FIG. 7 also depicts the path that light emitted from an inner LED 60D may take after reflecting from an inner surface; light emitted from outer LED 60E is reflected downward to increase the overall omnidirectional brightness of the lighting element.

Figure 8:
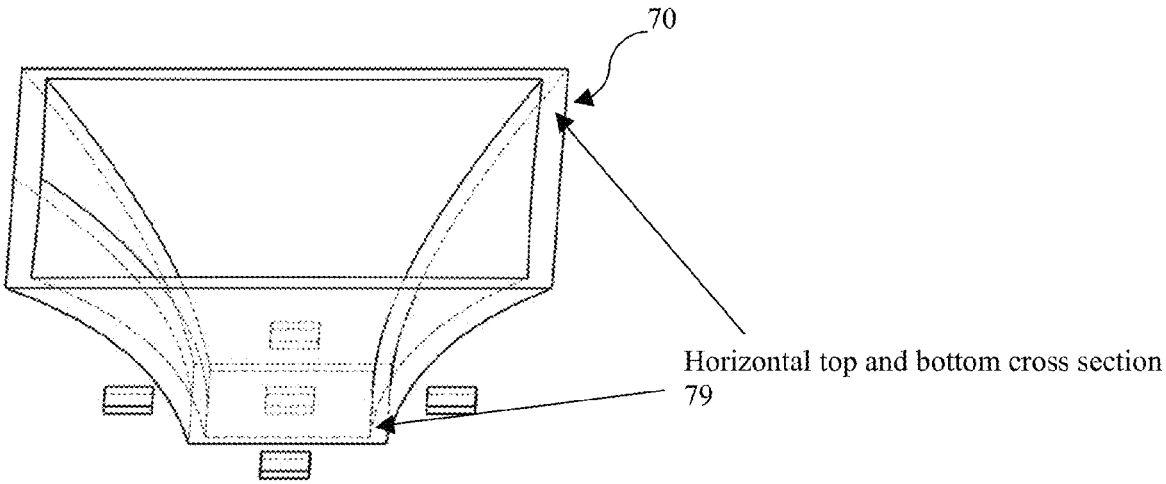
FIG. 8 depicts a concave shaped hollow light diverting component having a rectangular cross-sectional base.
Figure 9:
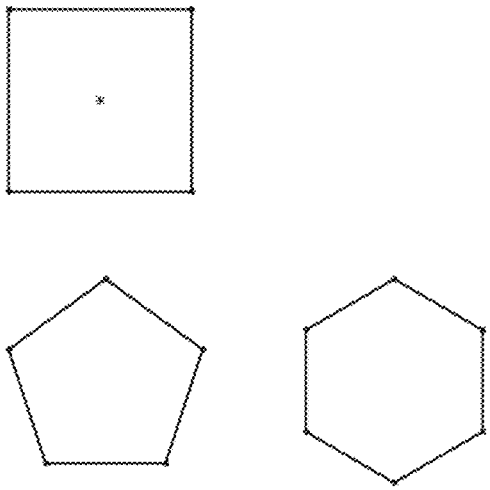
FIG. 9 depicts exemplary cross-sectional shapes for the hollow light diverting components of the present invention.

In the configuration of FIG. 8, the hollow light diverting component has a rectangular cross-section 79. Other cross-sectional shapes are depicted in FIG. 9 although the hollow element can take on any desired cross-sectional shape.

In addition to the light reflecting function, hollow light diverting component 70 can perform other functions for the bulb 10. For example, when made of a heat conductive material, component 70 serves as a radiative heat dissipation element. Heat conductive materials include metallic and ceramic materials and combinations thereof. Component 70 can be placed in thermal connection with the heat conductive substrate surface 50 and/or heat dissipation portion 30 to allow generated heat from LEDs to be conducted and thermally radiated to the ambient. To further enhance the heat radiation capability, two fins are spaced 180 degrees apart from each other to maximize thermally radiative surfaces. As a result, the temperature of the LEDs can be maintained in a lower operating range to ensure higher light efficiency and attain longer LED life.

In another optional embodiment, the hollow light diverting component 70 can act as a signal transceiver. For this embodiment, the hollow component 70 is fabricated from a dielectric, such as a ceramic material, and an antenna pattern is disposed on inner and/or outer surfaces. The disposed antenna pattern can be used as a wireless lighting control signal receiver and/or transmitter in connection with a lighting controller (either a remote controller or a computer and other wireless devices). The antenna is electrically connected to a signal converter for controlling bulb operation in accordance with, for example, received signal for controlling intensity or power on/off functions.

Figure 10:
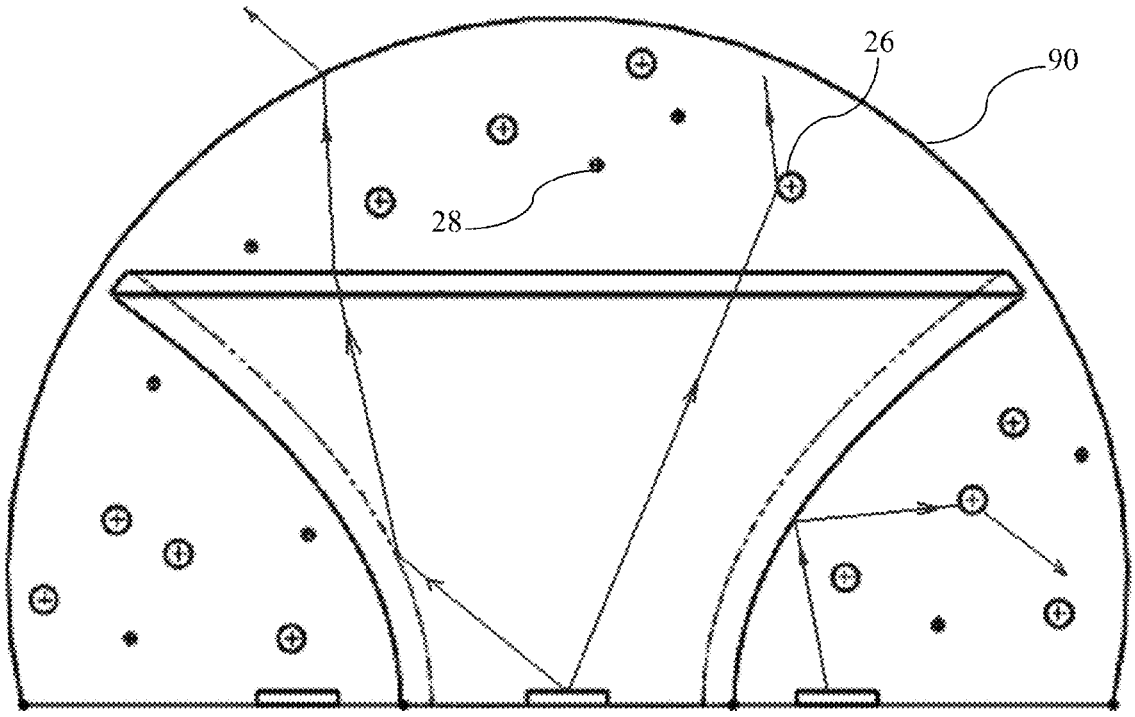
FIG. 10 depicts a lighting element package having a globe with a mixture of phosphor particles and scattering particles positioned over a light diverting component.

To further enhance the light emission characteristics of a lighting assembly using the hollow light diverting component of the present invention, a substantially transparent globe portion 90 can be included in the LED bulb 10 and can include one or kinds of materials to cause light scattering, alter the color of the light, etc. depending upon the desired final use of the lighting assembly. Globe portion 90 comprises silicone, epoxy or other substantially transparent organic or inorganic materials. As seen in FIG. 10, optional particles 26 in or on globe 90 cause scattering; the particles are selected from any kind of scattering particle such as oxides, polymers, etc. and can be formed within the material of globe 90. Particles 28 are optional phosphors; for example, if the LEDs emit blue light, yellow phosphors can be used to create a more aesthetically-pleasing emission color, e.g., to mimic the emission of an incandescent bulb. Other color-changing materials can be used in place of or in addition to phosphor particles 28, further plural different colors of the color-changing particles can be positioned in or on globe 90. Note that a mixture of color-changing materials that emit different colors can also be used.

The a spectrum of light emitted by the one or more LEDs is converted from a first spectrum of emitted light to a second spectrum that can comprise emitted and converted light as it passes through globe 90. A spectrum of light described herein can have contiguous or discontiguous wavelengths. For example, when the LED array 60 includes plural LEDs emitting different colors of light, the first emitted spectrum will have a range of discontiguous wavelengths. Alternatively, if all the LEDs emit the same color of light, the first spectrum will be contiguous. Similarly, a second spectrum of light that emerges from globe 90 may have contiguous or discontiguous wavelengths, depending upon the original emitted first spectrum and the number and colors of the color-changing particles selected for use with globe 90. Thus the first spectrum of light refers to the light as-emitted and the second spectrum to emitted and/or converted after passing through the glob and encountering the color-changing materials.

The foregoing has outlined the features and technical advantages of the present invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

The invention claimed is:

1. A wide angle emission LED assembly comprising:

a heat conductive substrate;

at least two light emitting diodes (LEDs) disposed on a surface of the heat conductive substrate, with at least one LED disposed at a predefined position within a central region of the surface, and with the remaining LEDs arranged surrounding the central LED;

a hollow light diverting component with a first opening at a first end adjacent to the substrate and a second opening larger than the first opening at the second end, the light diverting component being positioned over the heat conductive substrate with the first opening enclosing the central LED and at least one LED positioned outside the first opening, the hollow light diverting component being configured such that at least a portion of light emitted by the central LED is reflected off one or more inner surfaces of the hollow light diverting component to be discharged from the second opening, and the outer surfaces of the hollow light diverting component is configured to reflect at least a portion of light from the LEDs surrounding the central LED towards a region below the second opening of the hollow light diverting component;

wherein the inner surface of the hollow light diverting component is composed of one convex shaped surface and one sloping surface.

2. A wide angle emission LED assembly as set forth in claim 1 wherein the outer surface of the hollow light diverting component is a continuous concave shape facing toward the surrounding LEDs.

3. A wide angle emission LED assembly as set forth in claim 1 wherein the outer surface of the hollow light diverting component includes at least one concave surface and one sloping surface facing the surrounding LEDs.

4. A wide angle emission LED assembly as set forth in claim 1 wherein the outer surface of the hollow light diverting component includes a substantially vertical surface and a concave surface facing the surrounding LEDs.

5. A wide angle emission LED assembly as set forth in claim 1 wherein the heat conductive substrate has an optically reflective surface.

6. A wide angle emission LED assembly as set forth in claim 1 wherein the hollow light diverting component is composed of a metal, metal alloy, ceramic, or combination thereof to conduct the heat out of the assembly through thermal radiation.

7. A wide angle emission LED assembly as set forth in claim 1 wherein the hollow light diverting component is composed of ceramic material having one or more antenna patterns on at least one of the inner or outer surfaces.

8. A wide angle emission LED assembly as set forth in claim 1 wherein the surrounding LEDs are positioned either partially or entirely within an area defined by a projection of the second opening of the light diverting component onto the substrate surface.

9. A wide angle emission LED assembly as set forth in claim 1 further comprising a globe component disposed over the conductive substrate and enclosing both the LEDs and the light diverting component, the globe component including light scattering material positioned in or on the globe component to further disperse the light emitted by the LEDs.

10. A wide angle emission LED assembly as set forth in claim 1 further comprising a globe component disposed over the conductive substrate and enclosing both the LEDs and the light diverting component, the globe component further comprising a light spectrum converting materials positioned in or on the globe component for converting light emitted from the LEDs from a first spectrum to a second spectrum.

11. A wide angle emission LED assembly comprising:

a heat conductive substrate;

at least two light emitting diodes (LEDs) disposed on a surface of the heat conductive substrate, with at least one LED disposed at a predefined position within a central region of the surface, and with the remaining LEDs arranged surrounding the central LED;

a hollow light diverting component with a first opening at a first end adjacent to the substrate and a second opening larger than the first opening at the second end, the light diverting component being positioned over the heat conductive substrate with the first opening enclosing the central LED and at least one LED positioned outside the first opening, the hollow light diverting component being configured such that at least a portion of light emitted by the central LED is reflected off one or more inner surfaces of the hollow light diverting component to be discharged from the second opening, and the outer surfaces of the hollow light diverting component is configured to reflect at least a portion of light from the LEDs surrounding the central LED towards a region below the second opening of the hollow light diverting component;

wherein the inner surface of the hollow light diverting component is composed of one convex shaped surface and one concave shaped surface.

12. A wide angle emission LED assembly as set forth in claim 11 wherein the outer surface of the hollow light diverting component is a continuous concave shape facing toward the surrounding LEDs.

13. A wide angle emission LED assembly as set forth in claim 11 wherein the outer surface of the hollow light diverting component includes at least one concave surface and one sloping surface facing the surrounding LEDs.

14. A wide angle emission LED assembly as set forth in claim 11 wherein the outer surface of the hollow light diverting component includes a substantially vertical surface and a concave surface facing the surrounding LEDs.

15. A wide angle emission LED assembly as set forth in claim 11 wherein the heat conductive substrate has an optically reflective surface.

16. A wide angle emission LED assembly as set forth in claim 11 wherein the hollow light diverting component is composed of a metal, metal alloy, ceramic, or combination thereof to conduct the heat out of the assembly through thermal radiation.

17. A wide angle emission LED assembly comprising:

a heat conductive substrate;

at least two light emitting diodes (LEDs) disposed on a surface of the heat conductive substrate, with at least one LED disposed at a predefined position within a central region of the surface, and with the remaining LEDs arranged surrounding the central LED;

a hollow light diverting component with a first opening at a first end adjacent to the substrate and a second opening larger than the first opening at the second end, the light diverting component being positioned over the heat conductive substrate with the first opening enclosing the central LED and at least one LED positioned outside the first opening, the hollow light diverting component being configured such that at least a portion of light emitted by the central LED is reflected off one or more inner surfaces of the hollow light diverting component to be discharged from the second opening, and the outer surfaces of the hollow light diverting component is configured to reflect at least a portion of light from the LEDs surrounding the central LED towards a region below the second opening of the hollow light diverting component;

wherein the hollow light diverting component outer surface includes at least one concave surface facing toward the surrounding LEDs and at least two extension fins having substantially vertical surfaces that extend from the concave surface and are positioned between the surrounding LEDs; and wherein the extension fins are profiled to a selected curvature to control light emitted from the surrounding LEDs in a circumferential direction.

18. A light emitting lamp with wide light emission comprising:

a wide angle emission LED assembly as set forth in claim 1;

a transparent or translucent enclosure with a predefined shape covering the wide angle emission LED assembly; and a heat dissipation member supporting the wide angle emission LED assembly and the transparent or translucent enclosure.

19. A light emitting lamp with wide light emission comprising:

a wide angle emission LED assembly as set forth in claim 11;

a transparent or translucent enclosure with a predefined shape covering the wide angle emission LED assembly; and a heat dissipation member supporting the wide angle emission LED assembly and the transparent or translucent enclosure.

20. A light emitting lamp with wide light emission comprising:

a wide angle emission LED assembly as set forth in claim 17;

a transparent or translucent enclosure with a predefined shape covering the wide angle emission LED assembly; and a heat dissipation member supporting the wide angle emission LED assembly and the transparent or translucent enclosure.

* * * * *